US010101118B2

(12) United States Patent
Roberts et al.

(10) Patent No.: US 10,101,118 B2
(45) Date of Patent: Oct. 16, 2018

(54) FIREARM ACCESSORY ATTACHMENT SYSTEM

(71) Applicant: Magpul Industries Corp., Austin, TX (US)

(72) Inventors: Timothy Eric Roberts, Broomfield, CO (US); Michael T. Mayberry, Denver, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/692,120

(22) Filed: Aug. 31, 2017

(65) Prior Publication Data

US 2018/0003460 A1 Jan. 4, 2018

(51) Int. Cl.

| | |
|---|---|
| ***F41A 15/00*** | (2006.01) |
| ***F41C 27/00*** | (2006.01) |
| *F41C 23/16* | (2006.01) |

(52) U.S. Cl.

CPC ..... *F41C 27/00* (2013.01); *F41C 23/16* (2013.01)

(58) Field of Classification Search

CPC ..... F41C 27/00; F41C 23/16
USPC ..... 42/90, 124
See application file for complete search history.

(56) References Cited

U.S. PATENT DOCUMENTS 6,442,883 B1 * 9/2002 Waterman ..... F41G 11/003 42/124
7,562,484 B2 * 7/2009 Kim ..... F41G 11/003 24/282
7,685,759 B2 * 3/2010 Teetzel ..... F41G 11/003 42/127
7,823,316 B2 * 11/2010 Storch ..... F41G 11/003 42/127
8,091,265 B1 1/2012 Teetzel et al.
(Continued)

FOREIGN PATENT DOCUMENTS

WO 2009134491 A2 11/2009

OTHER PUBLICATIONS

ADE Advanced Optics, "ADE Advanced Optics Rifle Scope Angle Mount Double 13-Slot Rail With Integral QD Lever Lock System", Retrieved from https://www.amazon.com/Ade-Advanced-Optics-13-Slot-Integral/dp/B00R136274, Known to exist as early as Oct. 21, 2015, pp. 6.

(Continued)

*Primary Examiner* — Samir Abdosh
(74) *Attorney, Agent, or Firm* — Neugeboren O'Dowd PC

(57) ABSTRACT

A firearm accessory attachment system and method are disclosed. The system has a first body having a longitudinal length, a first protrusion coupled to and extending from the first body in a first direction, and a second protrusion coupled to and extending from the first body in the first direction as the first protrusion, the second protrusion is a first longitudinal distance from the first protrusion. The system also has a second body having a third protrusion coupled thereto, the third protrusion extending in the first direction. The second body is slidable relative to the first body. The system is movable between a locked configuration having a first width and an unlocked configuration having a second width, the second width less than the first width, the first and second widths defined by a direction transverse relative to the longitudinal length.

20 Claims, 16 Drawing Sheets

(56) References Cited

U.S. PATENT DOCUMENTS

| | | | | |
|---|---|---|---|---|
| 8,800,194 | B2 * | 8/2014 | Teetzel | F41G 11/003 42/124 |
| 8,806,796 | B1 * | 8/2014 | Clifton | F41G 11/003 42/127 |
| 9,038,305 | B2 * | 5/2015 | Volfson | F16M 13/02 42/90 |
| 9,677,854 | B1 * | 6/2017 | Tran | F41G 11/003 |
| 9,964,380 | B1 * | 5/2018 | Oglesby | F41C 27/00 |
| 2011/0138673 | A1 * | 6/2011 | Deros | F41G 11/003 42/90 |
| 2015/0285584 | A1 * | 10/2015 | Mayberry | F41C 23/16 42/71.01 |
| 2016/0349011 | A1 * | 12/2016 | Jen | F41G 11/001 |

OTHER PUBLICATIONS

Sport Optics, "Aimpoint QRP Comp Mount Complete", Retrieved from http://www.sportoptics.com/aimpoint-qrp-12245.aspx, Known to exist as early as Oct. 22, 2015, pp. 2.

Alamo Four Star, "DLOC-Aim", Retrieved from http://www.alamofourstarcom/index_php?page=shop.product_details&flypage=flyp, Known to exist as early as Oct. 21, 2015, pp. 2.

American Defense MFG, LLC, "AD-RECON-H Scope Mount I Item No: AD-RECON-H", Retrieved from http://www.americandefensemfg.com/view/product/188/, Known to exist as early as Oct. 21, 2015, pp. 3.

A.R.M.S., Inc., "A.R.M.S. #19 ACOG Throw Lever Mount", Retrieved from https://www.armsmounts.com/default.asp?mode=products&sub=mounts&id=%5bhsh%5d19%20ACOG, Known to exist as early as Oct. 21, 2015, pp. 1.

Bobro Engineering, "ACOG Mounts", Retrieved from http://www.bobroengineering.com/browse/category/acog-mounts/, Known to exist as early as Oct. 21, 2015, pp. 1.

Burris, "AR-P.E.P.R. Scope Mount", Retrieved from http://www.burrisoptics.com/ar-p.e.p.r.-scope-mount, Known to exist as early as Oct. 21, 2015, pp. 2.

Ergo Grips, "Ergo Xpress Lever Picatinny Mount", Retrieved from https://web.archive.org/web/20151129124732/http://ergogrips.net/ergo-xpress-lever-picatinny-mount.html, Known to exist as early as Oct. 21, 2015, pp. 1.

GG&G, "Accucam Quick Detach ACOG Mounting Base", Retrieved from https://www.gggaz.com/accucam-quick-detach-acog-mounting-base.html, Known to exist as early as Oct. 21, 2015, pp. 2.

Kinect Development Group, "Kinect QD MLOK Mounts", Retrieved from https://kineticdg.com/product-category/kinect/, Known to exist as early as Oct. 21, 2015, pp. 2.

Larue Tactical, "Larue Tactical SPR / M4 Scope Mount QD LT104", "Retrieved from http://www.larue.com/larue-tactical-spr-m4-scope-mount-qd-lt-104", Oct. 20, 2015, pp. 2.

Leapers, Inc., "UTG Quad-Rail/3 Slot Angle Mount w/ QD Lever Mount", Retrieved from http://www.leapers.com/prod_detail.php?level1=Angle_Mount&itemno=MAQ032263, Known to exist as early as Oct. 21, 2015, pp. 2.

Leupold & Stevens, Inc., "QR Remington 700 2-PC", Retrieved from https://www.leupold.com/tactical/mounting-systems/guick-release-mounting-systems/qr-remington-700-2-pc/, Known to exist as early as Oct. 21, 2015, pp. 11.

Surefire, LLC., "M720V Raid Weaponlight—White and IR Output", Retrieved from http://www.suretire.com/illumination/weaponlights/rifle-carbine-smg/raidweaponlight/m720v.html, Known to exist as early as Oct. 21, 2015, pp. 2.

Hammers, "Flat Top Offset One Piece Qd Scope Mount With Quick Release Cam Locks 1913 Picatinny Rails", Retrieved from https://www.amazon.com/Offset-Piece-Scope-Release-Picatinny/dp/B006MYCIOE, Known to exist as early as Oct. 21, 2015, pp. 7.

VLTOR Weapons Systems, "SM-O: Offset Scout Mount", Retrieved from https://www.vltocom/shop/light-mounts/sm-o-offset-scout-mount/, Known to exist as early as Oct. 21, 2015, pp. 3.

Warne Scope Mounts, "201L 1 Inch Quick Detach Medium Rings", Retrieved from http://warnescopemounts.com/product/201l-1-inch-quick-detach-medium-rings/, Known to exist as early as Oct. 21, 2015, pp. 2.

* cited by examiner

FIREARM ACCESSORY ATTACHMENT SYSTEM

CROSS-REFERENCE TO RELATED APPLICATIONS

The present Application for Patent is a Continuation of patent application Ser. No. 15/333,997 entitled "FIREARM ACCESSORY ATTACHMENT SYSTEM" filed Oct. 25, 2016, pending, which claims benefit to Provisional Application No. 62/255,052 filed on Nov. 13, 2015 and entitled "FIREARM ACCESSORY ATTACHMENT SYSTEM," the details of which are hereby incorporated by reference in their entirety for all proper purposes, as if fully set forth herein.

FIELD OF THE INVENTION

The present invention relates to firearms, and, more specifically, to accessories for firearms.

BACKGROUND OF THE INVENTION

In the firearms industry, a number of devices, systems, and methods are available to enable users to attach accessories to the firearm. In some cases, tool-less attachment of accessories when interfacing with a 1913 Picatinny rail are available, including attaching a Picatinny rail to an M-LOK standard slot. However, the available tool-less mounting devices generally include very bulky levers and locking features, or do not provide a stable mounting feature. For example, as illustrated in FIG. 22, some currently-available devices provide a mounting system having a spring feature that biases two feet away from each other along a longitudinal axis of the device. To attach the system to a firearm, the user presses the ends towards each other, inserts the system, and then allows the feet to release back out.

The system in FIG. 22 is not reliable, however, and may be prone to accidental release and toggling. The system also may exhibit a lack of stability, particularly when loaded to a side of the firearm, because the system contacts the firearm at just two points along the longitudinal axis. Moreover, because the system interfaces exclusively or nearly exclusively with the two end points, mechanical loading at those end points may be exacerbated. The system illustrated in FIG. 22 also may not provide enough tolerance to accept thick-walled applications such as polymer handguards. Additionally, the buttons seen on ends of the device in FIG. 22 can interfere with other devices, accessories, and portions of the firearm when these buttons are in an extended position (as shown). This design also limits a length of the device to a dimension between a user's index finger and thumb, since such outstretched fingers are needed in order to press the two buttons to release the device from a firearm or attach it. In other words, devices of this design can become so long that two hands are needed to release and attach the device, a situation that is often not acceptable where a second hand is needed to hold the firearm.

There therefor remains a need in the industry for an accessory mounting system that can be attached without the use of tools while providing a more stable and reliable interface.

SUMMARY

An exemplary firearm accessory attachment system is disclosed. An exemplary system has a first body having a longitudinal length, a first protrusion coupled to and extending from the first body in a first direction, and a second protrusion coupled to and extending from the first body in the first direction, the second protrusion positioned a first longitudinal distance from the first protrusion. The exemplary system has a second body having a third protrusion coupled thereto, the third protrusion extending from the second body in the first direction, the second body slidable relative to the first body. The exemplary system is movable between a locked configuration having a first width and an unlocked configuration having a second width, the second width less than the first width, the first and second widths defined by a direction transverse relative to the longitudinal length.

An exemplary method of using a firearm accessory attachment system includes providing a firearm accessory attachment system, the system having: (a) a first body having a longitudinal length, a first protrusion coupled to the first body, the first protrusion extending in a first direction from the first body, and a second protrusion coupled to and extending in the first direction from the first body, the second protrusion positioned a first longitudinal distance from the first protrusion, and (b) a second body having a third protrusion coupled thereto, the third protrusion extending in the first direction from the second body, the second body slidable relative to the first body. The exemplary method further includes moving the system between a locked configuration having a first width and an unlocked configuration having a second width, the second width less than the first width, the first and second widths defined by a direction transverse relative to the longitudinal length.

An exemplary method of making a firearm accessory attachment system includes providing a first body having a longitudinal length, a first protrusion coupled to the first body, the first protrusion extending in a first direction from the first body, and a second protrusion coupled to and extending the first direction from the first body, the second protrusion positioned a first longitudinal distance from the first protrusion. The exemplary method also includes providing a second body having a third protrusion coupled thereto, the third protrusion extending in the first direction from the second body, the second body slidable relative to the first body.

The exemplary method also includes providing an actuator configured to move the system between a locked configuration having a first width and an unlocked configuration having a second width, the second width less than the first width.

DETAILED DESCRIPTION

Figure 1:
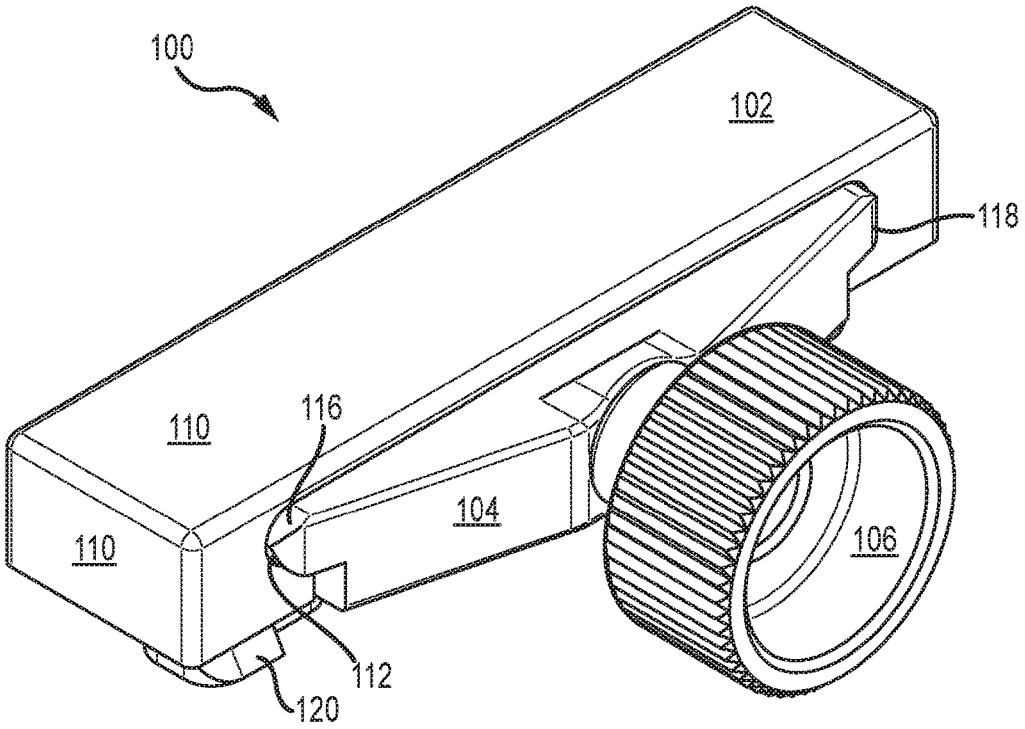
FIG. 1 is a perspective view of a firearm accessory mounting system according to some embodiments.
Figure 16:
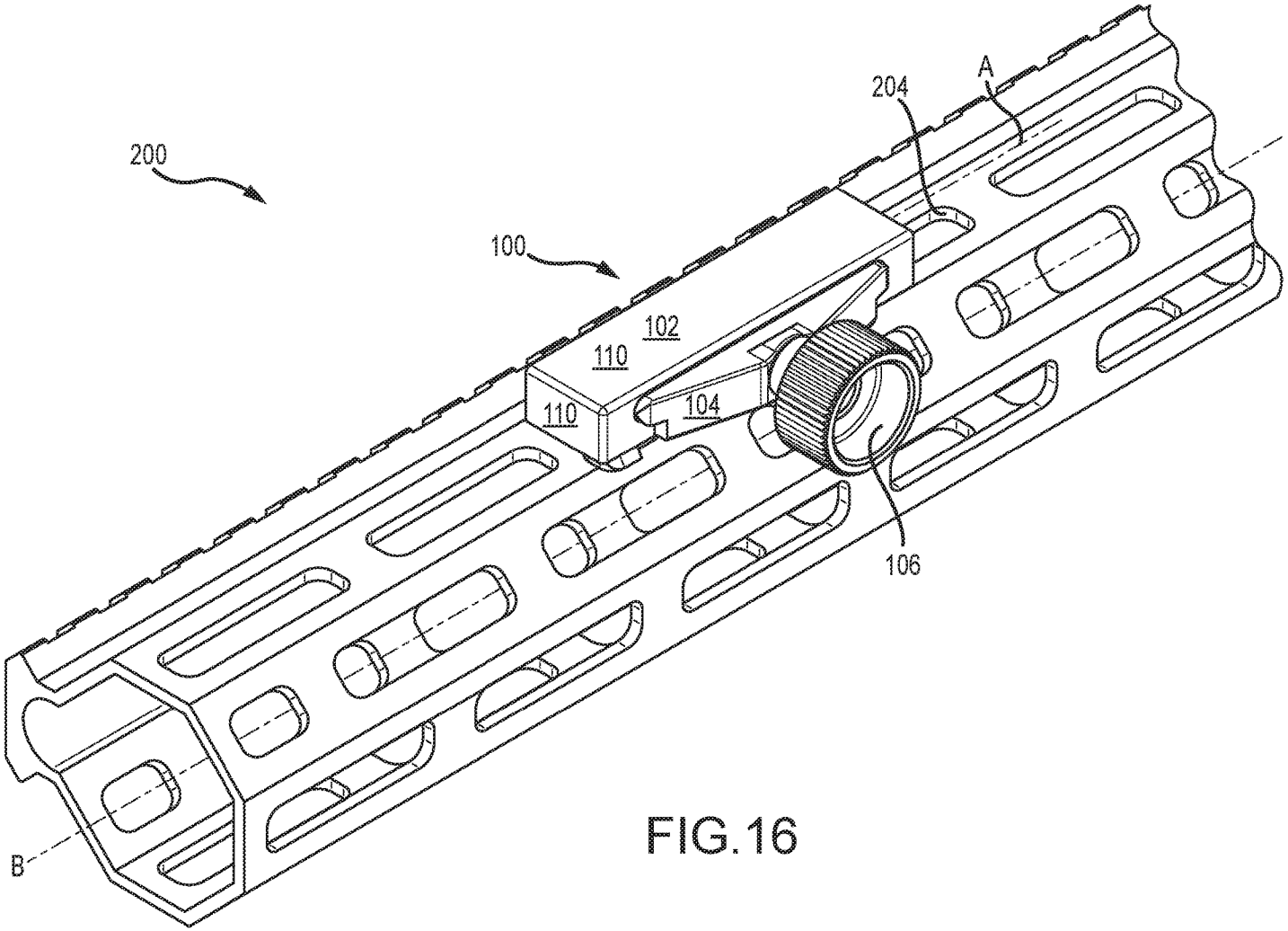
FIG. 16 is a perspective view of the system in FIG. 1 assembled to a handguard.

Referring now to the drawings, where like or similar elements are designated with identical reference numerals throughout the several views, and referring in particular to FIG. 1, it illustrates a firearm accessory mounting system 100, or system 100 for short. The system 100 has a first body 102, a second body 104 movable relative to the first body 102, and an actuator 106 for effecting relative movement between the first and second bodies 102, 104. In some embodiments, the system 100 is configured to releasably and without the use of external tools engage a slot 202, 204 (see e.g. FIGS. 16 and 18) or receiving feature of another component of a firearm such as a handguard 200. In some embodiments, the system 100 is configured to engage at least two ends of a first elongated slot 202 and at least one end of a second elongated slot 204. In some embodiments, the system 100 is biased towards, movable towards, and/or fixable in a locked configuration (see e.g. FIG. 20) wherein at least one flanged protrusion 120 in the first body 102 engages a first side wall 206 of a first slot 202, and at least one flanged protrusion 122 in the second body 104 engages an opposing second side wall 208 of the slot 202. An inwardly-projecting protrusion 124 in the first body 102 or the second body 104 may be provided and configured to assist in aligning the system 100 longitudinally relative to the firearm, component, or handguard 200. The system 100 may be constructed of any materials suitable for the purpose of reliably attaching to a firearm component or handguard over time. Moreover, those skilled in the art will understand that any one or all of the illustrated components of the system 100 may be made or manufactured as a unitary component, or may be made of an assembly of elements coupled together. For example only, although the first body 102 is illustrated as a single element, the first body 102 may include a plurality of separate pieces, such as an upper piece and a lower piece, coupled together using any means known to those skilled in the art. A better understanding of the details of some embodiments may be had from the following paragraphs. For the purpose of this application, the phrase "inwardly-projecting" may be interchanged with "downward" or "downwardly-projecting".

With reference to FIGS. 16-20, in some embodiments, in the locked configuration (see FIG. 20), a second flanged protrusion 126 in the first body 102 may engage a first side wall 210 in a second slot 204 of the firearm, component, or handguard 200, and a second flanged protrusion 128 in the second body 104 may engage a second side wall 212 in the second slot 204. Relatedly, the protrusion 124 in the first or second body 104 may engage a first or second side wall 206, 208, 210, 212 in either the first or second slots 202, 204, depending on where the protrusion 124 is placed in the system 100, so as to stabilize the system 100 when it is mounted to the firearm, component, or handguard 200. That is, those skilled in the art will understand that, although the protrusion 124 is illustrated as part of the first body 102, the protrusion 124 may similarly be a part of the second body 104 and achieve the same function.

Figure 18:
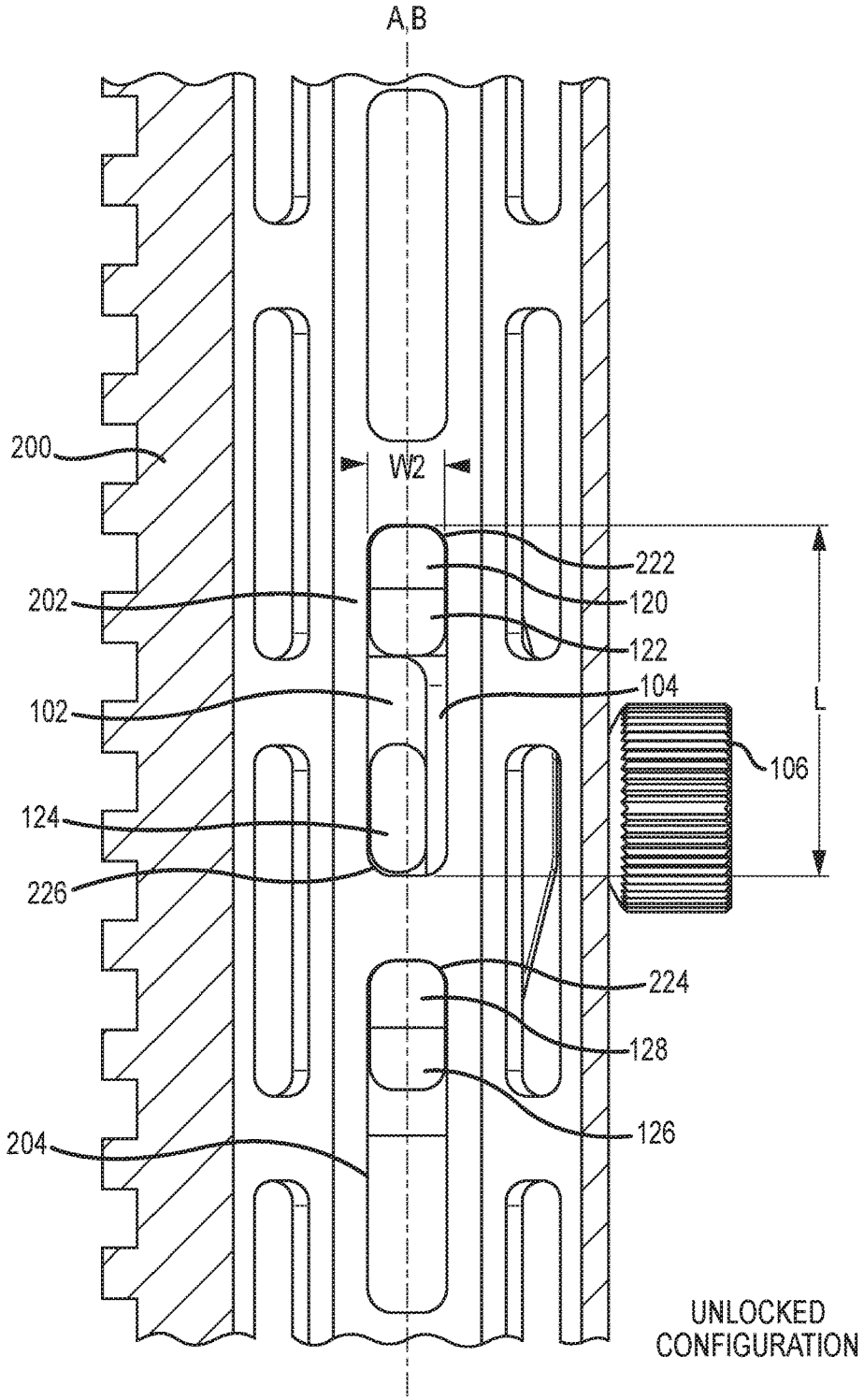
FIG. 18 is a section view of the assembly in FIG. 16, illustrating the system in a fully unlocked configuration.
Figure 19:
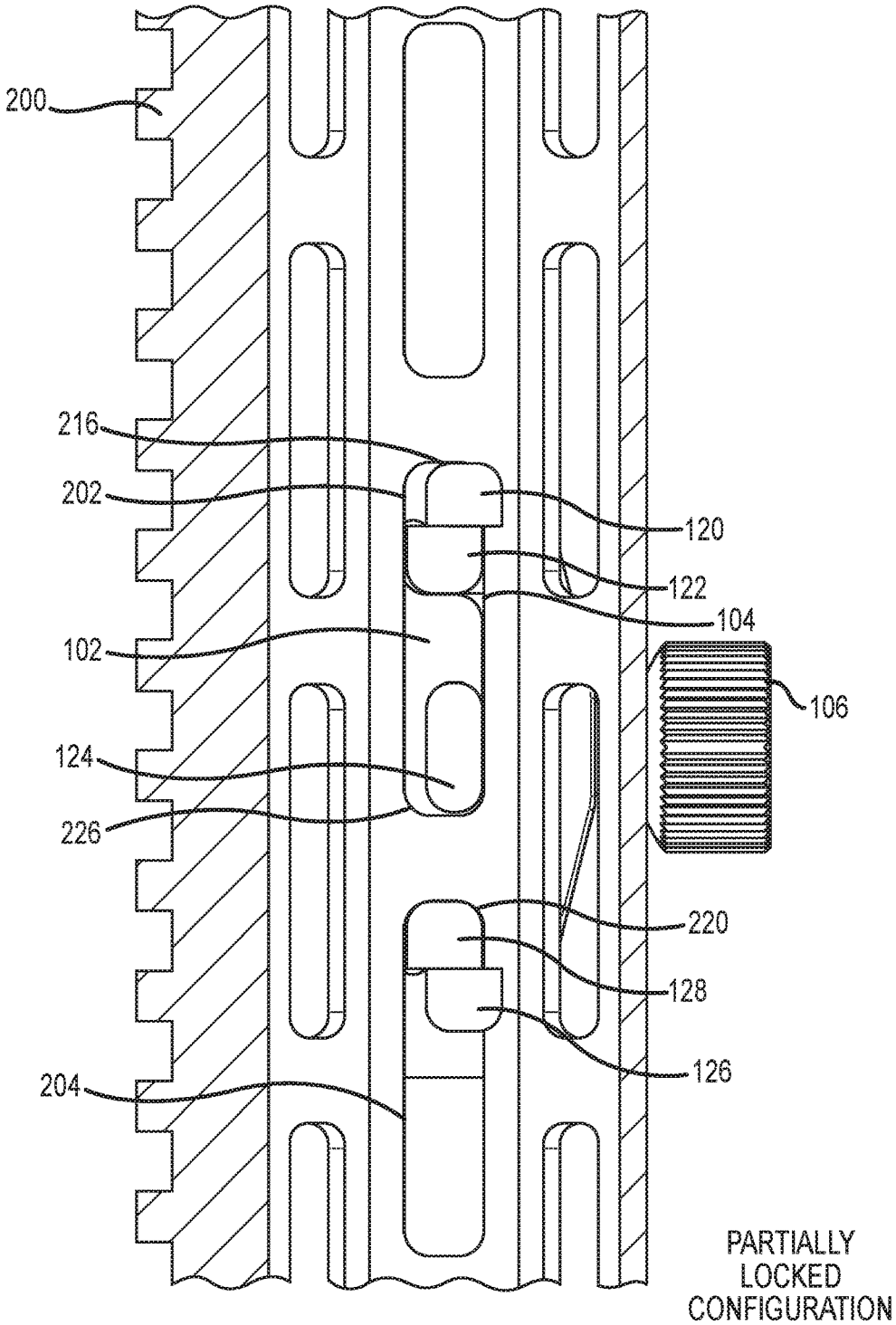
FIG. 19 is a section view of the assembly in FIG. 16, illustrating the system in a partially locked configuration.
Figure 20:
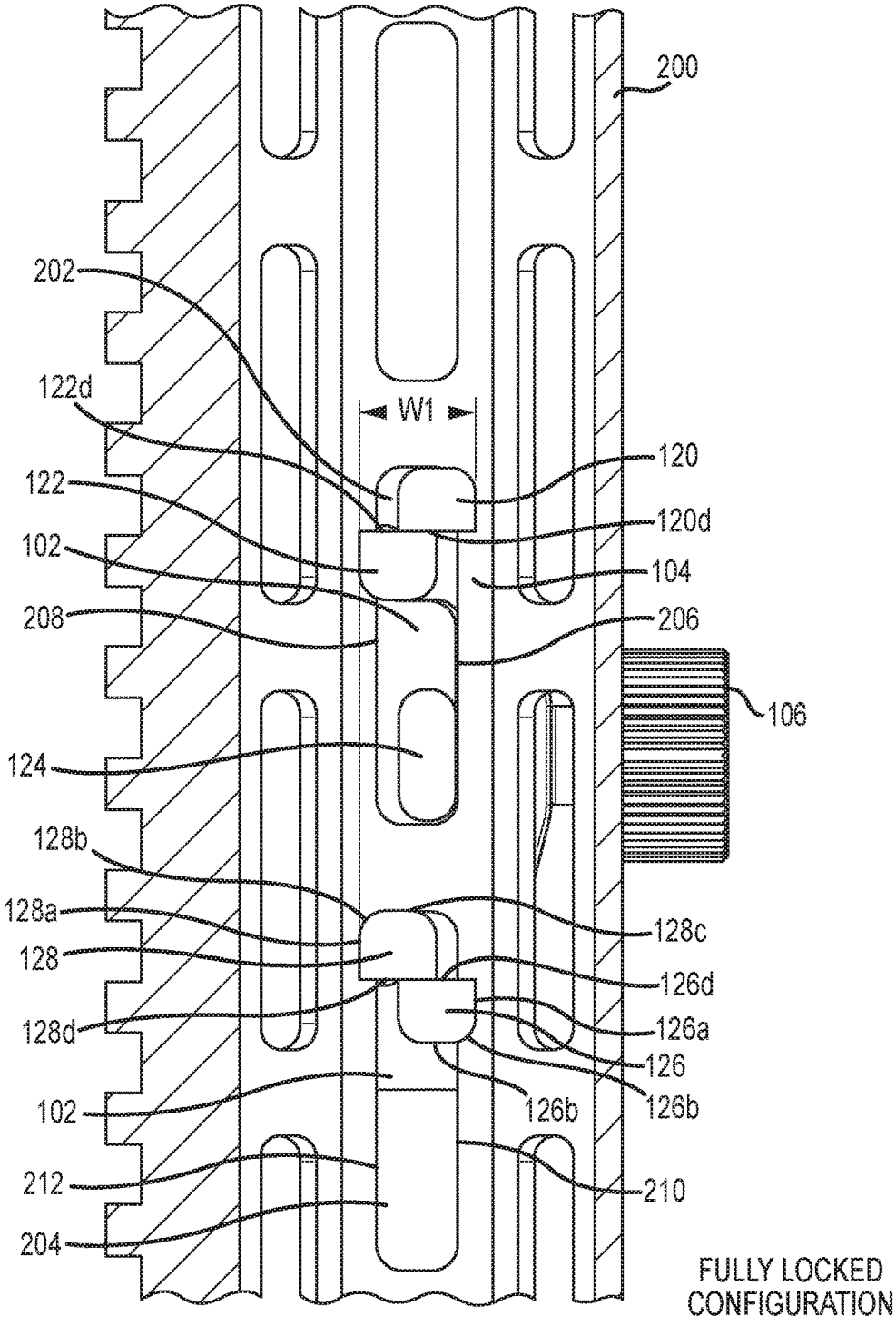
FIG. 20 is a section view of the assembly in FIG. 16, illustrating they system in a fully locked configuration.

As illustrated by comparing FIG. 20 and FIG. 19, the actuator 106 may be configured to move the system between a locked configuration as illustrated in FIG. 20 and an unlocked configuration as illustrated in FIG. 18. The locked configuration may have a first envelope flange width W1 defined by flanges 120, 122 in the first and second bodies 102, 104 (see e.g. FIG. 20), or by flanges 120, 128. The unlocked configuration may have a second envelope flange width W2 defined by the flanges 120, 122 or the flanges 120, 128 that is less than the first envelope flange width W1 (see e.g. FIG. 18).

The inwardly-projecting protrusion 124 may be referred to herein as a positioning protrusion, and may be provided to generally position the system, first body 102, and/or second body 104 relative to a firearm 200 (compare FIG. 18 to FIG. 20). The protrusion 124 may be without flanges.

Returning now to FIG. 1, as well as FIGS. 2-7, the first body 102 has an accessory feature or accessory 110. Although the figures illustrate the accessory 110 as a flat face, those skilled in the art will understand that the accessory 110 may be any accessory now known or as yet to be developed, including, but not limited to, a Picatinny rail, a Weaver rail, any other style mounting rail, a light, a scope, a bipod, etc. The accessory 110 may be on a top section of the first body 102 as illustrated, or it may be on a fore section, aft section, side section, or any combination thereof.

Figure 2:
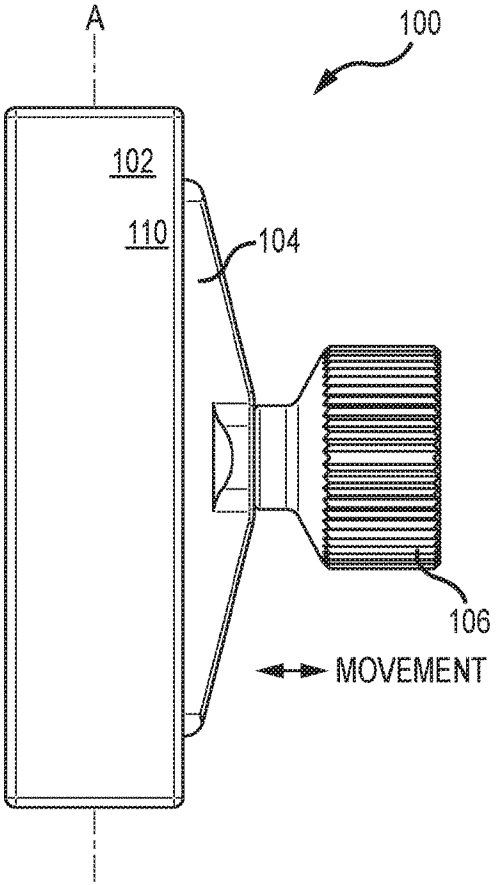
FIG. 2 is a top view of the system in FIG. 1.
Figure 4:
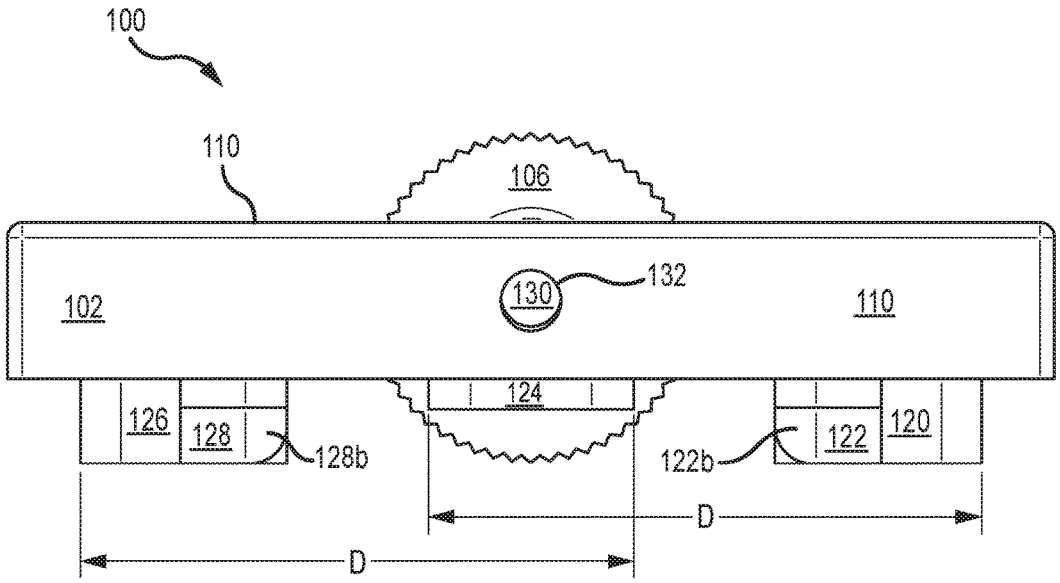
FIG. 4 is a side view of the system in FIG. 1.
Figure 5:
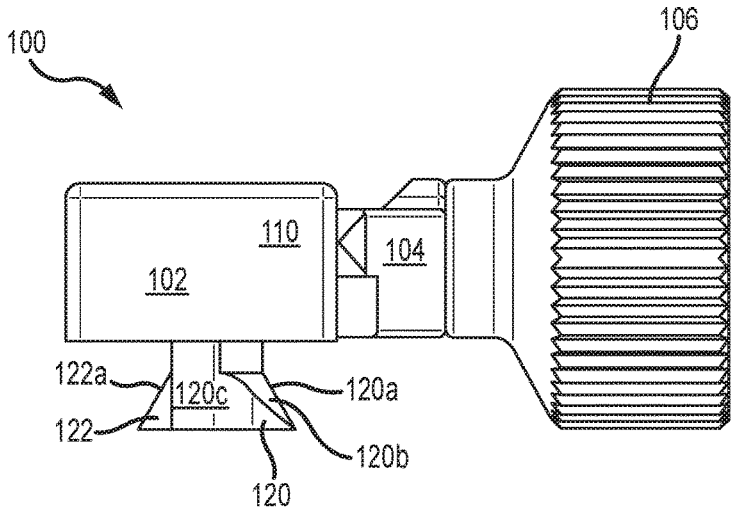
FIG. 5 is an end view of the system in FIG. 1.
Figure 6:
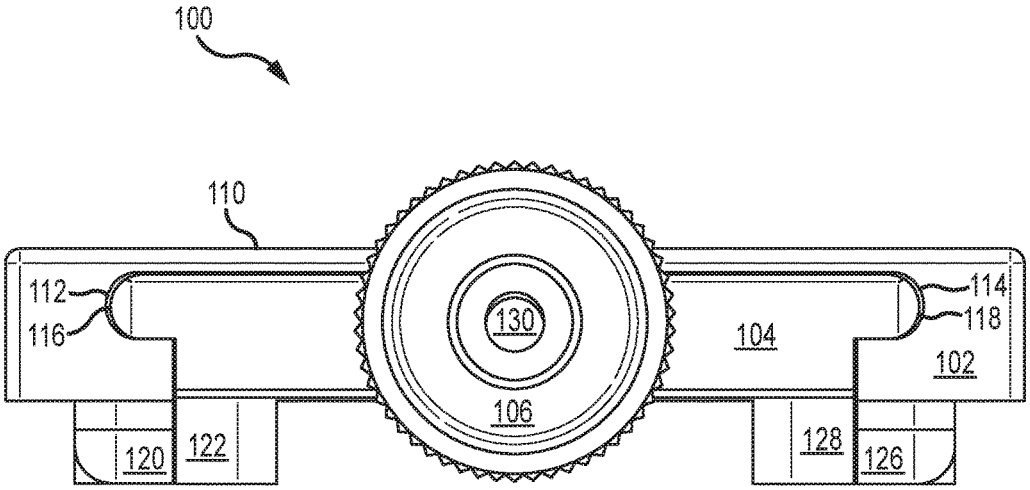
FIG. 6 is a second side view of the system in FIG. 1.
Figure 9:
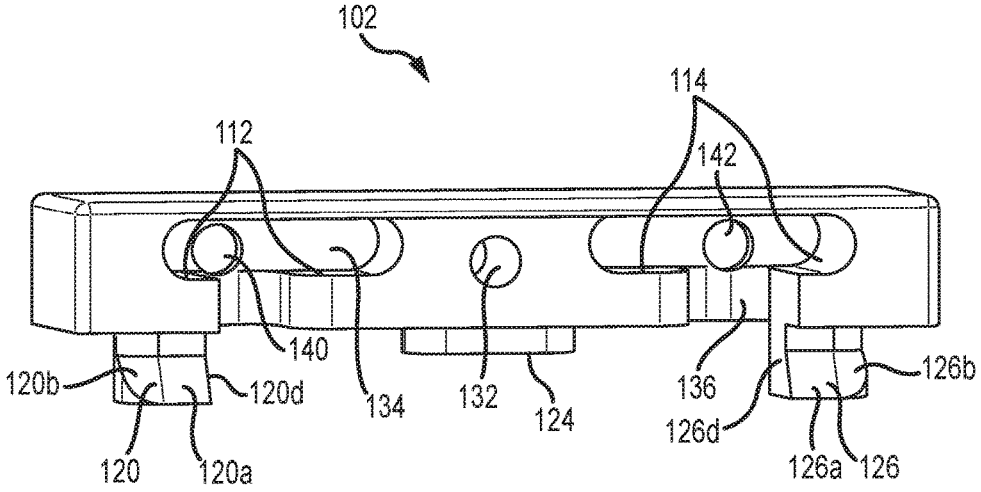
FIG. 9 is a perspective view of a first body of the system in FIG. 1.

The second body 104 is movable relative to the first body 102 in response to actuation or adjustment of the actuator 106. In some embodiments, the second body 104 is slidable in a direction that is transverse to a longitudinal axis A of the system 100, as illustrated in FIG. 2, in response to a rotation of the actuator 106. The system 100 may be configured such that the longitudinal axis A is substantially parallel to a longitudinal axis B of the firearm or a slot 202, 204 in a handguard 200 of the firearm (see e.g. FIGS. 16 and 18) when the system 100 is assembled to the component or handguard 200. In some embodiments, the first body 102 may have first and/or second guides 112, 114, as illustrated in. FIG. 9, which may include shelf or recess features for slidably receiving a portion the second body 104. In some embodiments, the second body 104 may include first and/or second rails 116, 118 (see e.g. FIG. 12) for interfacing with the first body 102. That is, the first body 102 may have a receiving slot, shelf, flange, or feature for engaging the second body 104, and the second body 104 may have a flange, shelf, or projection for engaging the first body 102. Other means for sliding engagement are possible.

Figure 7:
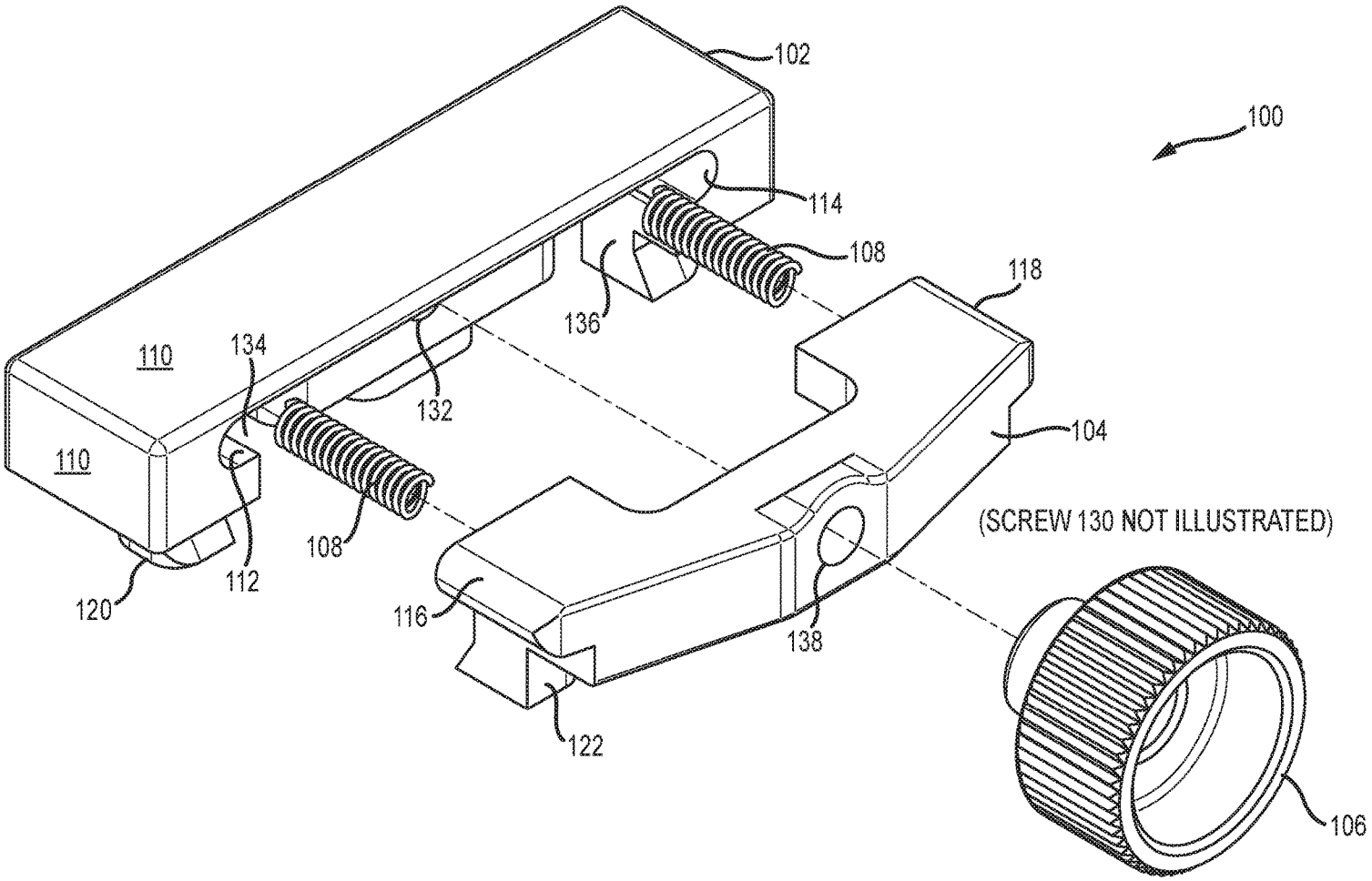
FIG. 7 is an exploded perspective view of the system in FIG. 1.
Figure 8:
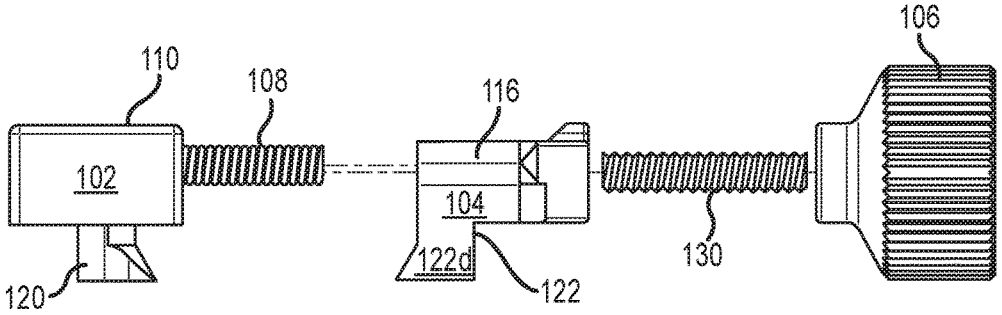
FIG. 8 is an exploded end view of the system in FIG. 1.
Figure 14:
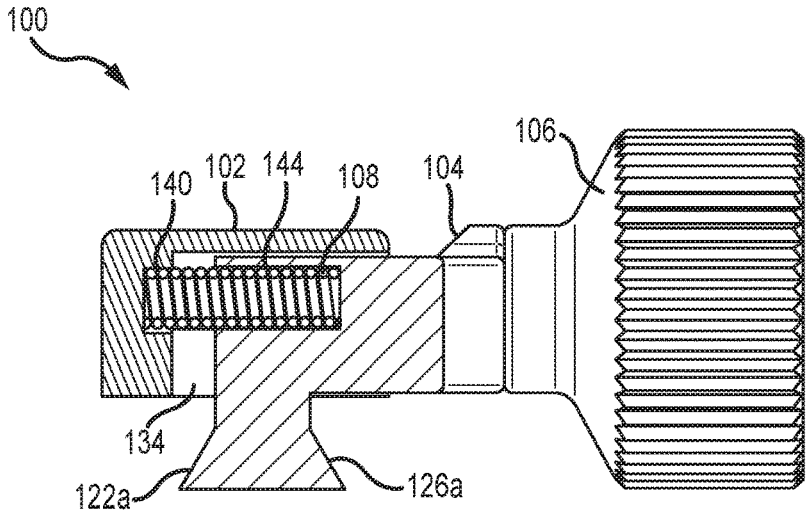
FIG. 14 is another section view illustrating details of the system in FIG. 1.

As most clearly seen in FIGS. 7, 8, and 14, the system 100 may include a biasing mechanism 108 such as a spring to bias the system 100 towards the locked configuration or the unlocked configuration. The actuator 106 may be provided to allow a user to move translate the second body 104 relative to the first body 102 towards an unlocked configuration. The actuator 106 may include a screw 130 or bolt coupled to the actuator 106, passing through a passage in the second body 104, and rotatably engaged with the first body 102, whereby, upon rotation of the actuator 106, the screw 130 may move the first and second bodies 102, 104 between the locked and unlocked configurations.

Figure 13:
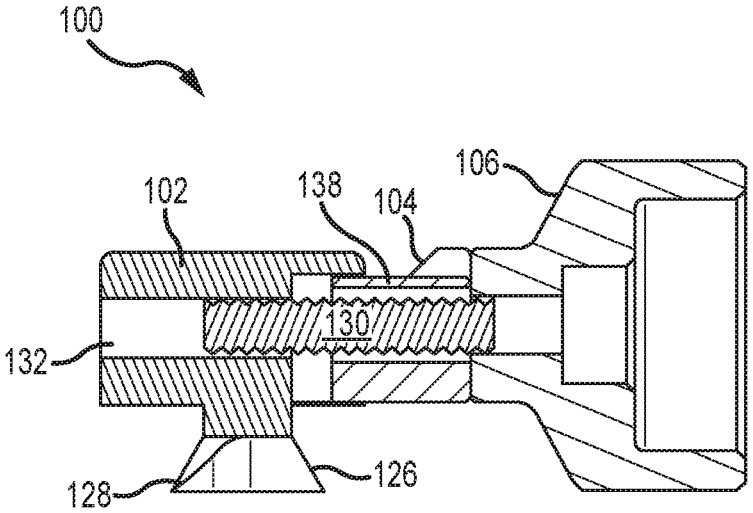
FIG. 13 is a section view illustrating details of the system in FIG. 1.
Figure 15:
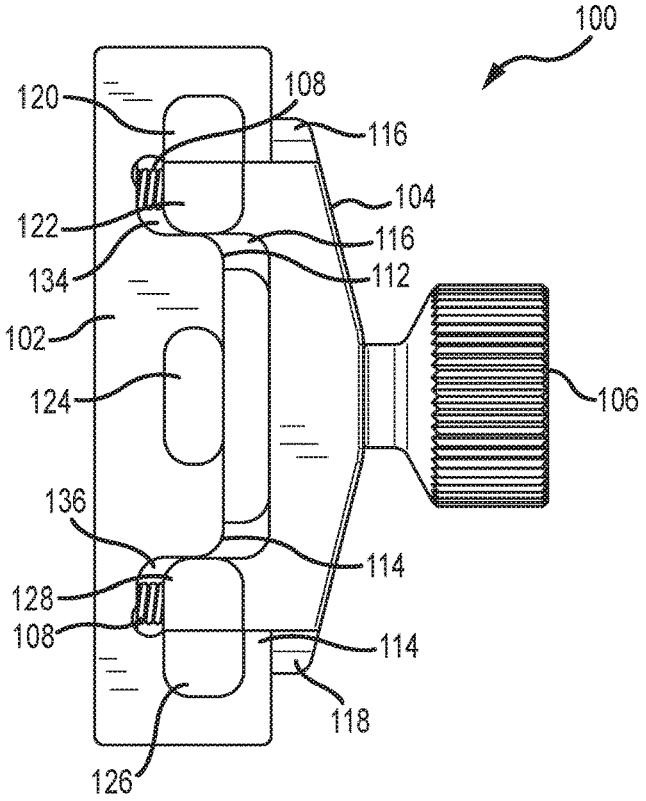
FIG. 15 is a bottom view of the system in FIG. 1 in a fully unlocked configuration.

In some embodiments, and as illustrated in FIG. 13, the biasing mechanism 108 does not effectuate movement of the second body 104, but merely applies a force on the second body 104, with the actuator 106 and a screw 130 maintaining, fixing, or moving the second body 104 in a locked configuration, an unlocked configuration, or a configuration therebetween in response to user adjustment of the actuator 106. The unlocked configuration is illustrated in FIG. 15. In some embodiments, a cap screw or a leadscrew may be used to translate a turning motion of the actuator 106 into a linear motion of the second body 104. Those skilled in the art will understand that any number of threaded configurations may be suitable. Although not illustrated, the actuator 106 or actuation system may be configured to prevent a user from disassembling the system 100 completely or over-tightening the system 100, such as by way of using travel stops, thread disengagements, and/or other mechanisms known to those skilled in the art. Other means of moving the second body 104 relative to the first body 102 include one or more rotating cam levers mounted on a side or end of the first body, an actuator knob in an orientation other than that shown, a biasing element such as a spring, a releasable or permanent ratcheting mechanism, a cam lobe or lobes on a shaft running the length of the system, one or more sliding wedges actuated by a lever or knob. Those skilled in the art will envision any number of alternative means for converting a rotating motion into a linear motion.

Figure 10:
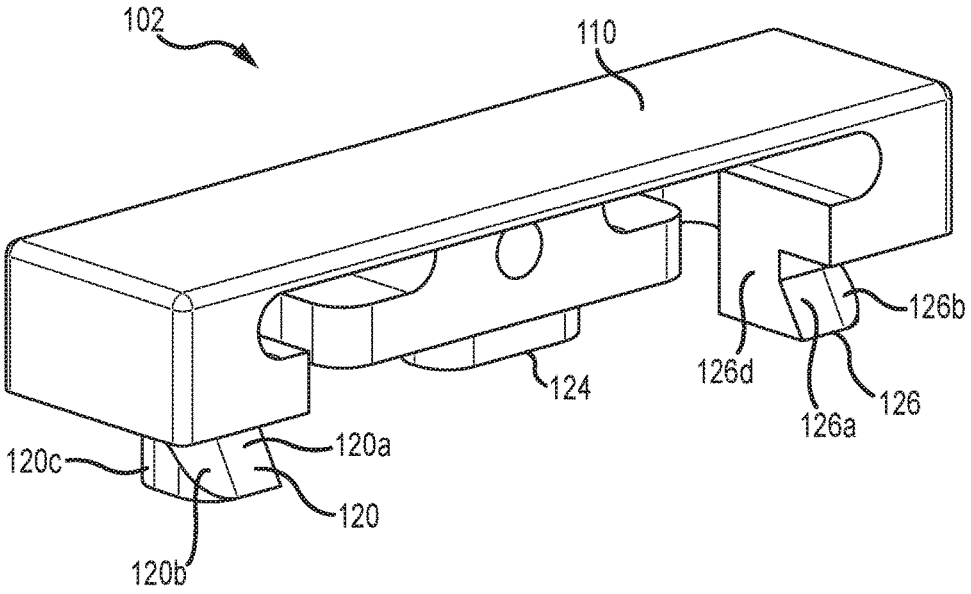
FIG. 10 is another perspective view of the first body in FIG. 9.

Turning now to FIG. 10, the flanged protrusions 120, 122, 126, 128, may have engagement surfaces that are configured to engage the slot(s) 202, 204 at an angle, even where the slot(s) 202, 204 include walls 206, 208, 210, 212 having surfaces that are substantially parallel with or perpendicular to the longitudinal axis B of the component or handguard 200. That is, the flanged protrusions 120, 122, 126, 128 may be configured to apply a progressively tightening force about or against multiple walls of a slot 202, 204.

As illustrated in FIGS. 10 and 20, the first flanged protrusion 120 may have a first engagement surface 120*a* for engaging a first side wall of a slot 202, 204 when in the locked configuration, a second engagement surface 120*b* for engaging a corner of the slot 202, 204 when in the locked configuration, and a third engagement surface 120*c* for slidably engaging an end wall of the slot 202, 204 when moving between the locked and unlocked configuration. The first flanged protrusion 122 in the second body 104 may likewise have first, second, and third engagement surfaces 122*a*, 122*b*, 122*c*, for engaging, respectively, a first side wall, a corner, and an end wall of a slot 202, 204 in a manner as described with reference to the first flanged protrusion 120 of the first body 102. The second flanged protrusions 126, 128 of the first and second bodies 102, 104 may likewise have first, second, and third engagement surfaces 126*a*, 126*b*, 126*c*, 128*a*, 128*b*, 128*c* as described above.

Figure 11:
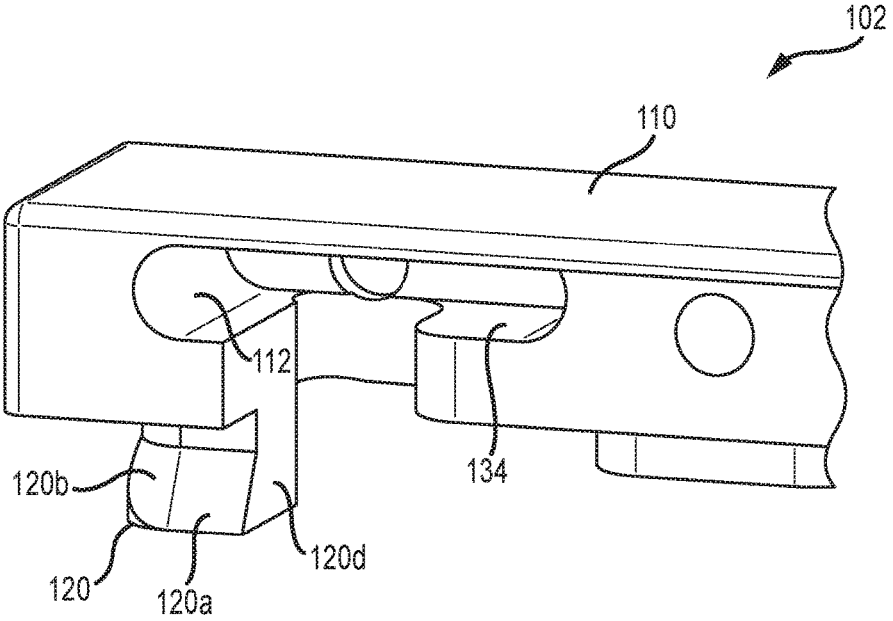
FIG. 11 is a perspective view of some details of the first body in FIG. 9.
Figure 12:
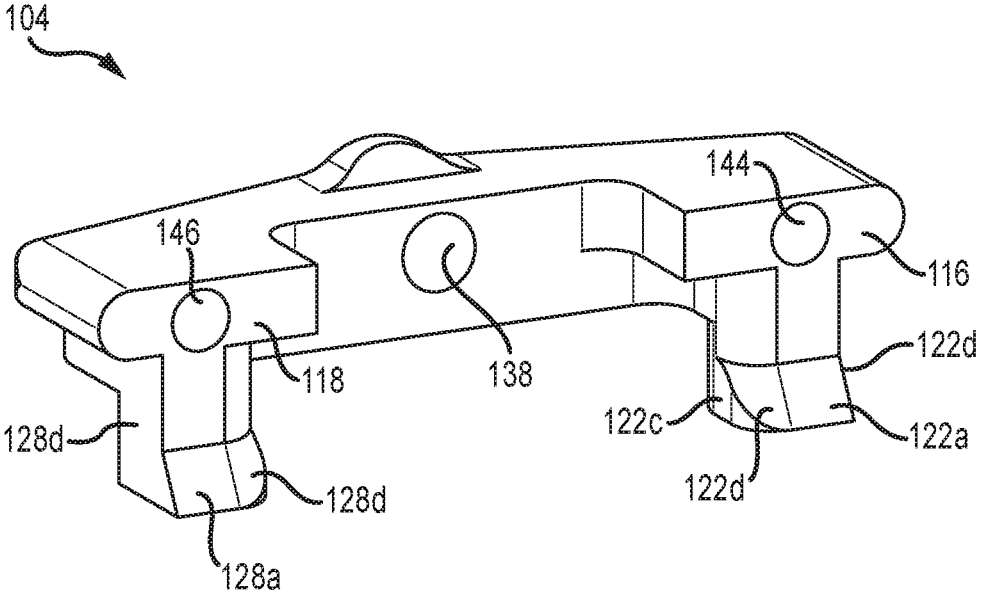
FIG. 12 is a perspective view of the second body in FIG. 1.

Notably, the first flanged protrusion 120 of the first body 102 may also include a fourth engagement surface 120*d*, as illustrated in FIG. 11, for slidingly engaging or abutting a respective fourth engagement surface 122*d*, as illustrated in FIG. 12 and FIG. 20, in the first flanged protrusion 122 of the second body 104. The second flanged protrusions 126, 128 in the first and second bodies may also have a fourth engagement surface for slidingly engaging respective others of the second flanged protrusions 126, 128. In some embodiments, the flanged protrusions 120, 126 of the first body 102 remain engaged with the flanged protrusions 122, 128 of the second body 104 in the locked and unlocked configurations, as well as during translation between the locked and unlocked configurations. By providing flanged protrusions 120, 122, 126, 128 that engage each other in both the locked and unlocked configurations (see e.g. FIGS. 18-20), the flanged protrusions 120, 122, 126, 128 provide a more stabilized and/or robust attachment to the firearm component or handguard 100.

Put succinctly, any one of the flanged protrusions 120, 122, 126, 128 may be configured to engage a slot 202, 204 of a firearm component or handguard 200 whereby, as the system 100 is moved towards the locked configuration, the protrusion 120, 122, 126, 128 applies longitudinal, lateral, and vertical forces on the slot 200. Those skilled in the art will understand that the configuration of the protrusions may be reversed from those illustrated. In some embodiments, the flanged protrusions 120, 126 in the first body 102 may apply longitudinal forces on the flanged protrusions 122, 128 in the second body 104 when in the locked configuration, for providing a firm fit. In some embodiments, the first flanges 120, 122 may have an interference fit in the locked configuration, and the second flanges 126, 128 may have an interference fit in the locked configuration.

Returning again to FIG. 10, an inwardly-projecting protrusion 124 may be provided on the first or second body 102, 104. The inwardly-projection protrusion 124 may be configured to abut a first or second side wall 206, 208, 210, 212 of a slot 202, 204 when the system 100 is in the locked configuration. Of note, the overall width W of the inwardly-projecting protrusion 124 is less than a width of the slot 202, 204, so as to allow the protrusion 124 to be inserted into and transversely moved within the slot 202, 204. In some embodiments, the protrusion 124 does not extend as far into the slot 202, 204 as does the flanged protrusions 120, 122, 126, 128. In some embodiments, the overall width W of the protrusion 124 is less than the maximum width of the flanged protrusions 120, 122, 126, 128.

Figure 17:
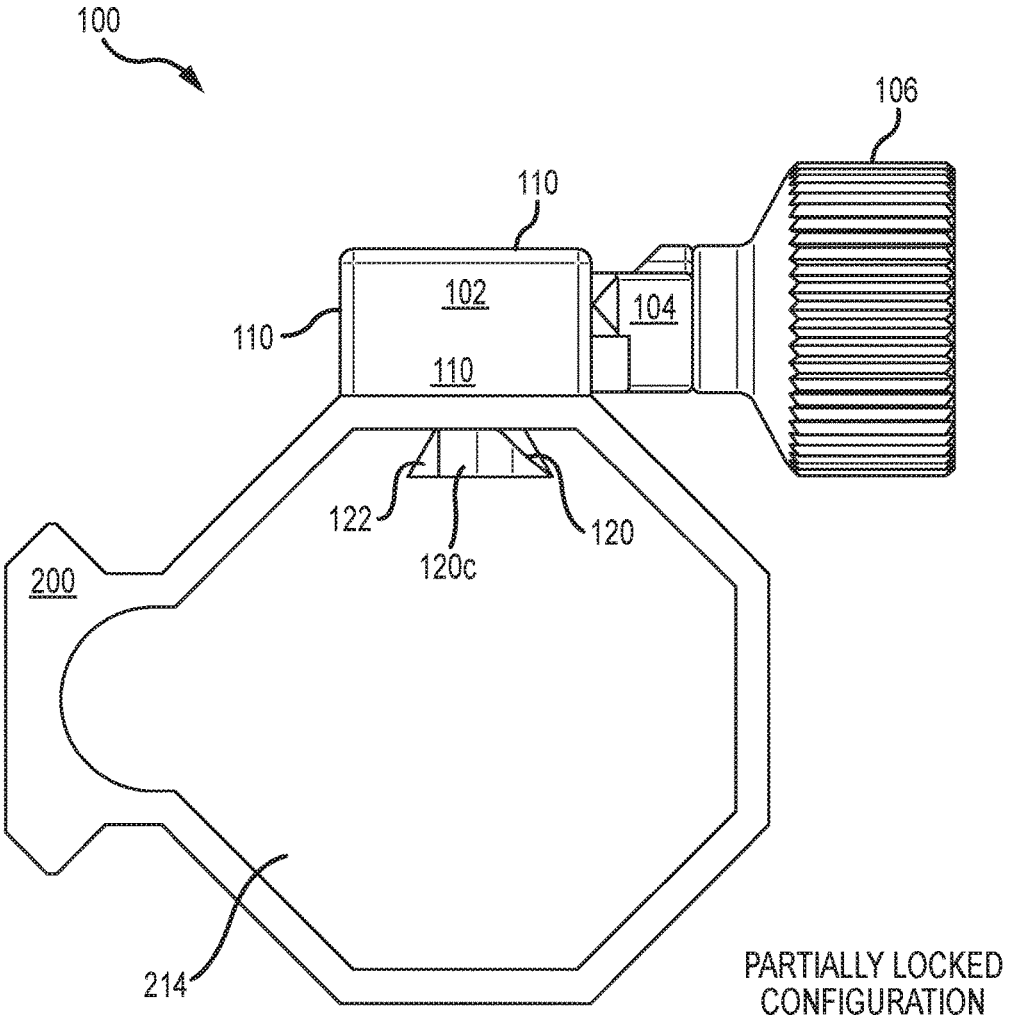
FIG. 17 is an end view of the assembly in FIG. 16.

In some embodiments, and as illustrated in FIG. 17, one or more of the flanged protrusions 120, 122, 126, 128 are shaped and configured such that at least a portion of the flanged protrusions may pass through a slot 202, 204 of a firearm or handguard 200 and into an interior space 214 of the firearm or handguard 200 when in the unlocked configuration, and, after adjustment of the system 100 into the locked configuration, the flanged protrusions 120, 122, 126, 128 are unable to pass through the slot 202, 204.

In some embodiments, the first flanged protrusions 120, 122 and the inwardly-projection protrusion 124 engage a first slot 202, and the second flanged protrusions 126, 128 engage a second slot 204 so as to reliably prevent movement of the system 100 relative to the firearm or handguard 200 while ensuring a strong engagement.

In some embodiments, the system 100 is configured to engage at least two elongated slots 202, 204 of a firearm component or handguard 200, such that at least two end walls 216, 218, 220 are engaged to prevent longitudinal movement of the system 100 relative to the firearm component or handguard 200 and at least two side walls 206, 208, 210, 212 are engaged to prevent transverse and vertical movement of the system 100 relative to the firearm component or handguard 200. In some embodiments, one or more corners 222, 224 of at least one slot 202, 204 may be engaged to prevent vertical movement of the system 100 relative to the firearm component or handguard 200 (see FIGS. 18 and 20). In some embodiments, a first corner 222 of a first slot 202 and a first corner 224 of a second slot 204 may be engaged to prevent vertical movement of the system 100 relative to the firearm component or handguard 200, while a second corner 226 of the first slot 202 may be engaged to limit longitudinal and/or transverse movement of the system 100 relative to the firearm component or handguard 200.

In some embodiments, an overall length L of the first slot 202 (see FIG. 18) is substantially equal to or just slightly greater than a distance D (see FIG. 4) between a fore end of the first flanged protrusion 120 in the first body 102 and an aft end of the inwardly-projecting protrusion 124, such that the system 100 may fit snuggly into the slot 202. In some embodiments, the distance D between the fore end of the first flanged protrusion 120 in the first body 102 and the aft end of the protrusion 124 is substantially the same as a distance D between an aft end of the second flanged protrusion 126 in the first body 102 and a fore end of the inwardly-projecting protrusion 124.

Figure 3:
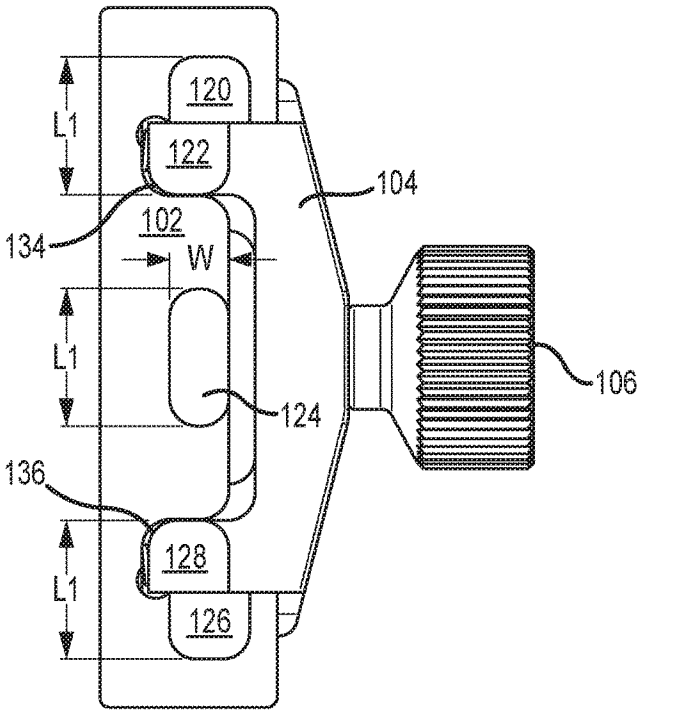
FIG. 3 is a bottom view of the system in FIG. 1.

In some embodiments, and as illustrated in FIG. 3, the inwardly-projecting protrusion 124 has a longitudinal length L1 that is greater than the width W. In some embodiments, the longitudinal length L1 is the same as a length L1 between the fore end of the first flanged protrusion 120 in the first body 102 and the aft end of the first flanged protrusion 122 in the second body 104. In some embodiments, the longitudinal length L1 is the same as a length L1 between the aft end of the second flanged protrusion 126 in the first body 102 and the fore end of the second flanged protrusion 128 in the second body 104.

Figure 21:
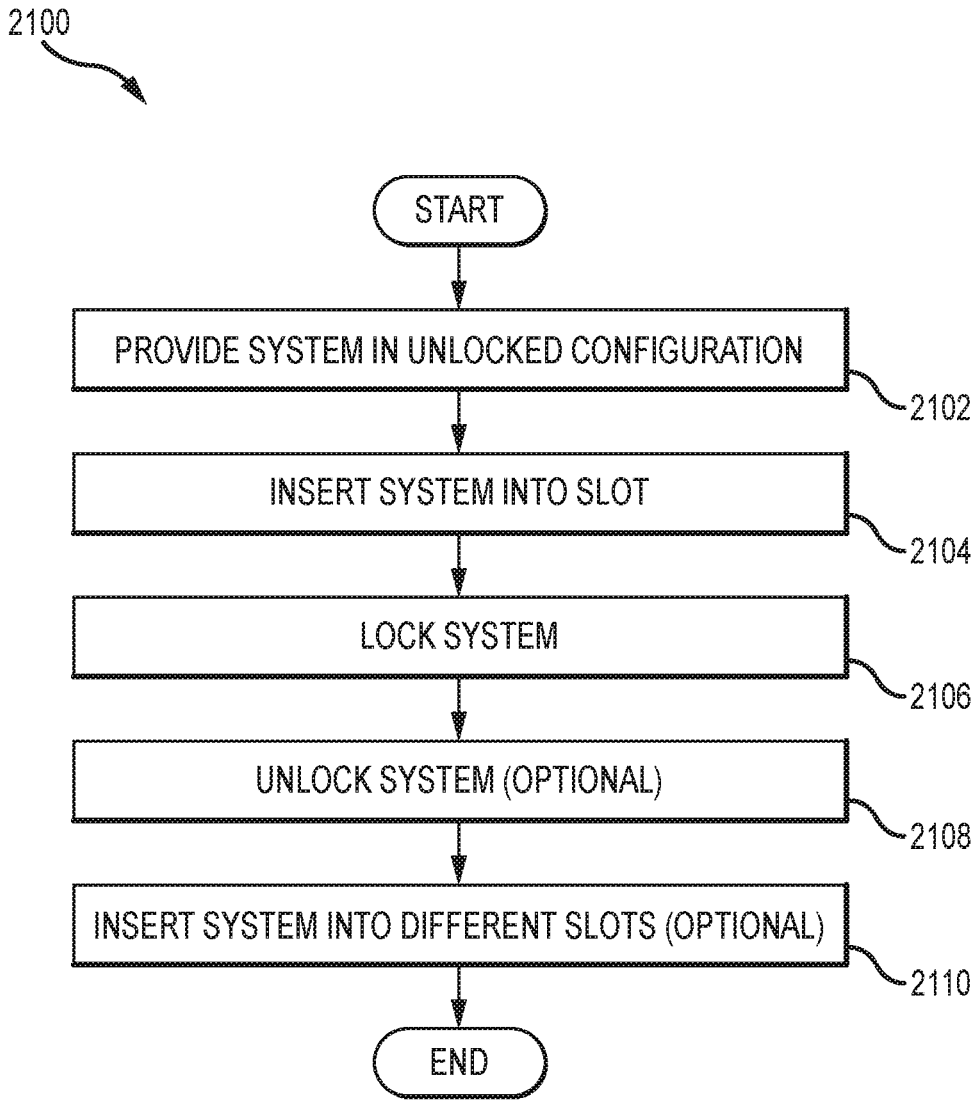
FIG. 21 is a flowchart of a method.
Figure 22:
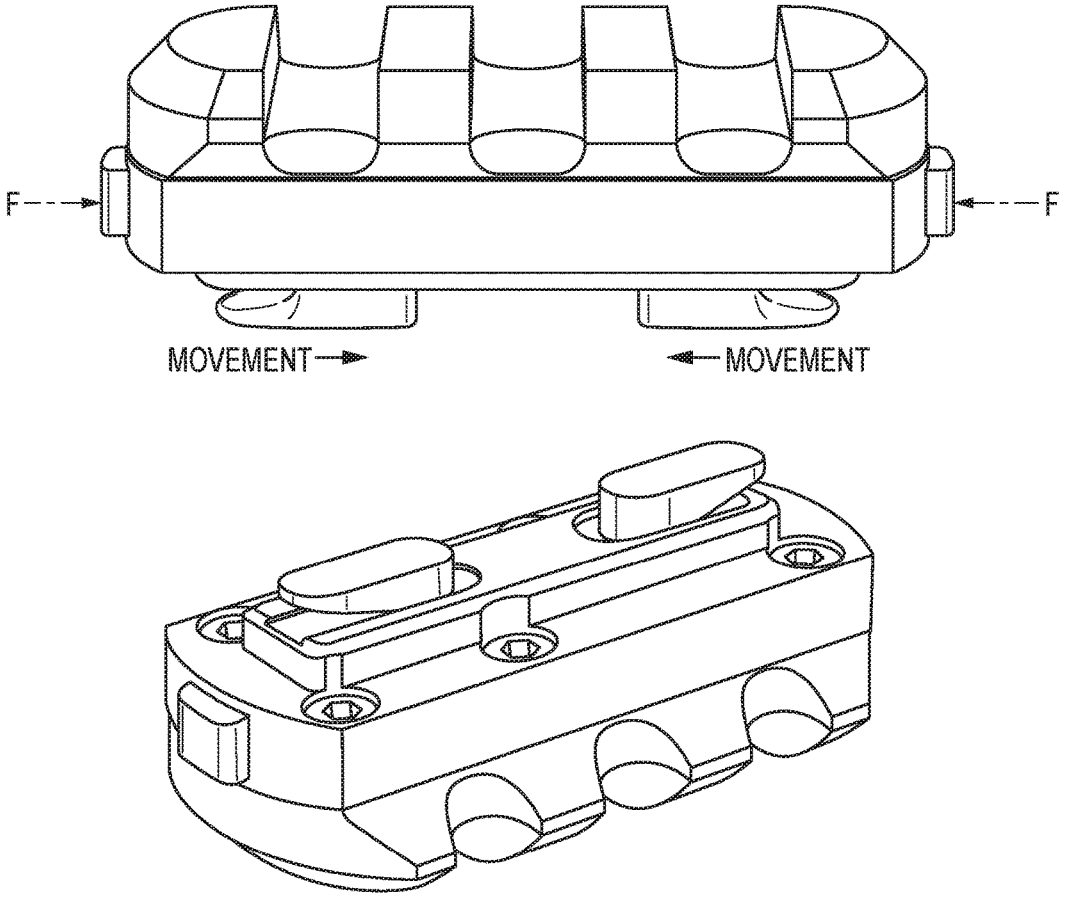
FIG.22 PRIOR ART
FIG. 22 is an illustration of a prior art device.

Turning now to FIG. 21, a method 2100 of using an accessory system is now described in greater detail. The method 2100 includes providing 2102 an accessory system, inserting 2104 the system into slots, and locking 2106 the system. The method 2100 may include unlocking 2108 the system and/or inserting 2110 the system into two slots and two different slots.

Providing 2102 includes providing an accessory system in an unlocked configuration, and may be achieved by providing the system 100 previously described herein in the unlocked configuration illustrated in FIG. 18.

Inserting 2104 the system into a slot includes inserting the system into at least one slot of a firearm component or handguard such that longitudinal movement of the system relative to the firearm component or handguard is limited. In some embodiments, inserting 2104 the system includes inserting the system into two slots of a firearm component or handguard such that longitudinal movement of the system relative to the firearm component or handguard is limited. In some embodiments, inserting 2104 the system includes inserting into three slots.

Locking 2106 the system includes adjusting an actuator to move the system from the unlocked configuration into a locked configuration wherein a flanged protrusion in a first body of the system engages a side wall of a first slot in the firearm component or handguard, a flanged protrusion in a second body of the system engages another side wall of the same slot or a second slot in the firearm component or handguard, and another protrusion that is not flanged engages one of the side walls of the first or second slot. Locking 2106 may be achieved by moving the system into the locked configuration illustrated in FIG. 20.

Unlocking 2108 the system is optional, and includes adjusting the actuator to move the system from the locked configuration to the unlocked configuration, thereby moving the flanged protrusions away from the walls of the firearm component or handguard.

Inserting 2110 the system into two slots is optional, and may include inserting 2110 into different slots, such as one of inserting the system such that different ones of the flanged protrusions in the first and second bodies engage different side walls of the same two slots; or the flanged protrusions in the first and second bodies engage different side walls of a different two slots of the firearm component or handguard. Inserting 2110 the system into different slots may be achieved using the system 100 previously described herein.

The terms and expressions employed herein are used as terms and expressions of description and not of limitation, and there is no intention, in the use of such terms and expressions, of excluding any equivalents of the features shown and described or portions thereof. In addition, having described certain embodiments, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of an actuator should be understood to encompass disclosure of the act of actuating—whether explicitly discussed or not—and, conversely, were there only disclosure of the act of actuating, such a disclosure should be understood to encompass disclosure of an actuating mechanism. Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. A firearm accessory attachment system, comprising:

a first body having a longitudinal length, a first protrusion coupled to and extending from the first body in a first direction, and a second protrusion coupled to and extending from the first body in the first direction, the second protrusion positioned a first longitudinal distance from the first protrusion; and a second body having a third protrusion coupled thereto, the third protrusion extending from the second body in the first direction, the second body slidable relative to the first body; wherein the system is movable between a locked configuration having a first width and an unlocked configuration having a second width, the second width less than the first width, the first and second widths defined by a direction transverse relative to the longitudinal length.

2. The system of claim 1, further comprising:

a positioning protrusion coupled to and extending in the first direction from at least one of the first or second bodies.

3. The system of claim 2, wherein:

the first protrusion is a flanged protrusion with a curved proximal surface;

the system has a fourth protrusion, the fourth protrusion being a flanged protrusion and having a curved proximal surface; and the positioning protrusion is positioned between the first and second protrusions, and has a curved distal surface.

4. The system of claim 3, wherein:

the positioning protrusion is coupled to the first body.

5. The system of claim 1, wherein:

the first protrusion has a curved proximal surface; and the system has a fourth protrusion having a curved proximal surface.

6. The system of claim 1, further comprising:

a fourth protrusion coupled to and extending in the first direction from the second body, the fourth protrusion positioned a second longitudinal distance from the third protrusion, the second longitudinal distance different from the first longitudinal distance.

7. The system of claim 1, further comprising:

an actuator configured to move the system between the locked configuration and the unlocked configuration; wherein the actuator is actuated by at least one of rotation, camming, or sliding.

8. The system of claim 7, wherein the actuator comprises:

at least one of a cam lever mounted on the first body, a biasing element, a releasable ratcheting mechanism, a permanent ratcheting mechanism, a cam lobe, or a wedge actuated by a lever or knob.

9. The system of claim 1, further comprising:

at least one of a travel stop, or a thread disengagement feature, to limit movement of the system to movement between and including the locked configuration and the unlocked configuration.

10. The system of claim 1, wherein the system is biased towards one of the locked configuration or the unlocked configuration.

11. The system of claim 1, further comprising:

a hand-operated actuator configured to move the system between the locked configuration and the unlocked configuration.

12. A method of using a firearm accessory attachment system, the method comprising:

providing a firearm accessory attachment system, the system comprising:

(a) a first body having a longitudinal length, a first protrusion coupled to the first body, the first protrusion extending in a first direction from the first body, and a second protrusion coupled to and extending in the first direction from the first body, the second protrusion positioned a first longitudinal distance from the first protrusion, and (b) a second body having a third protrusion coupled thereto, the third protrusion extending in the first direction from the second body, the second body slidable relative to the first body; and moving the system between a locked configuration having a first width and an unlocked configuration having a second width, the second width less than the first width, the first and second widths defined by a direction transverse relative to the longitudinal length.

13. The method of claim 12, further comprising:

providing a positioning protrusion coupled to and extending in the first direction from at least one of the first or second bodies, wherein the first protrusion has a curved proximal surface, the fourth protrusion has a curved proximal surface, the positioning protrusion is positioned between the first and second protrusions, and the positioning protrusion has a curved distal surface;

causing the first, second, and positioning protrusions to engage a first side wall of an elongated slot in a firearm; and causing the third protrusion and a fourth protrusion coupled to the second body to engage a second side wall of the elongated slot, the second side wall opposing the first side wall.

14. The method of claim 13, further comprising:

causing a proximal portion of the first protrusion to engage a curved surface in a first elongated slot in a firearm;

causing a proximal portion of the fourth protrusion to engage a curved proximal surface in a second elongated slot in a firearm.

15. The method of claim 12, further comprising:

providing a fourth protrusion coupled to and extending in the first direction from the second body, the fourth protrusion positioned a second longitudinal distance from the third protrusion, the second longitudinal distance different from the first longitudinal distance.

16. The method of claim 12, further comprising:

at least one of rotating, camming, or sliding an actuator to move the system between the locked configuration and the unlocked configuration.

17. The method of claim 12, further comprising:

biasing the system towards one of the locked configuration or the unlocked configuration.

18. The method of claim 12, further comprising:

manipulating an actuator by hand to move the system between the locked and unlocked configurations.

19. The method of claim 12, wherein the first, second, third, and fourth protrusions are flanged protrusions, the method further comprising:

moving the first and third flanged protrusions into or out of a first elongated slot in a firearm; and moving the third flanged protrusion into or out of a second elongated slot in the firearm.

20. A method of making a firearm accessory attachment system, comprising:

providing a first body having a longitudinal length, a first protrusion coupled to the first body, the first protrusion extending in a first direction from the first body, and a second protrusion coupled to and extending the first direction from the first body, the second protrusion positioned a first longitudinal distance from the first protrusion;

providing a second body having a third protrusion coupled thereto, the third protrusion extending in the first direction from the second body, the second body slidable relative to the first body; and providing an actuator configured to move the system between a locked configuration having a first width and an unlocked configuration having a second width, the second width less than the first width.

* * * * *